United States Patent [19]

Coone

[11] 4,403,660

[45] Sep. 13, 1983

[54] WELL PACKER AND METHOD OF USE THEREOF

[75] Inventor: Malcolm G. Coone, Houston, Tex.

[73] Assignee: MGC Oil Tools, Inc., Houston, Tex.

[21] Appl. No.: 176,403

[22] Filed: Aug. 8, 1980

[51] Int. Cl.[3] ..... E21B 33/127; E21B 33/128

[52] U.S. Cl. ..... 166/387; 166/179; 166/196

[58] Field of Search ..... 166/315, 187, 196, 179, 166/373, 387, 386

[56] References Cited

U.S. PATENT DOCUMENTS

| | | | |
|---|---|---|---|
| 2,945,665 | 7/1960 | Regan et al. | 166/196 X |
| 3,208,532 | 9/1965 | Chenoweth | 166/196 X |
| 3,227,462 | 1/1966 | Tamplen | 166/196 X |
| 3,283,823 | 11/1966 | Warrington | 166/187 X |
| 3,338,310 | 8/1967 | McGill | 166/187 X |
| 3,433,303 | 3/1969 | Clark, Jr. et al. | 166/196 X |
| 3,529,667 | 9/1970 | Malone | 166/187 X |
| 3,604,732 | 9/1971 | Malone | 166/187 X |
| 3,690,375 | 9/1972 | Shillander | 166/196 X |
| 3,899,631 | 8/1975 | Clark | 166/187 X |
| 4,063,427 | 12/1977 | Hoffman | 166/187 X |
| 4,253,676 | 3/1981 | Baker | 166/187 X |

*Primary Examiner*—Stephen J. Novosad
*Attorney, Agent, or Firm*—Vaden, Eickenroht, Thompson, Bednar & Jamison

[57] ABSTRACT

A packer and a method of setting a packer is disclosed that combines features of both compression-set packing elements and inflatable packing elements. The packing element of the packer includes elongated strips of reinforcing material that are bent away from the packer mandrel, when the packer is set, to move an annular body of elastomeric material into sealing engagement with an adjacent surface. Upstream pressure is supplied to the space between the mandrel and the packing element to help hold the packing element in such sealing engagement.

7 Claims, 13 Drawing Figures

FIG. 8
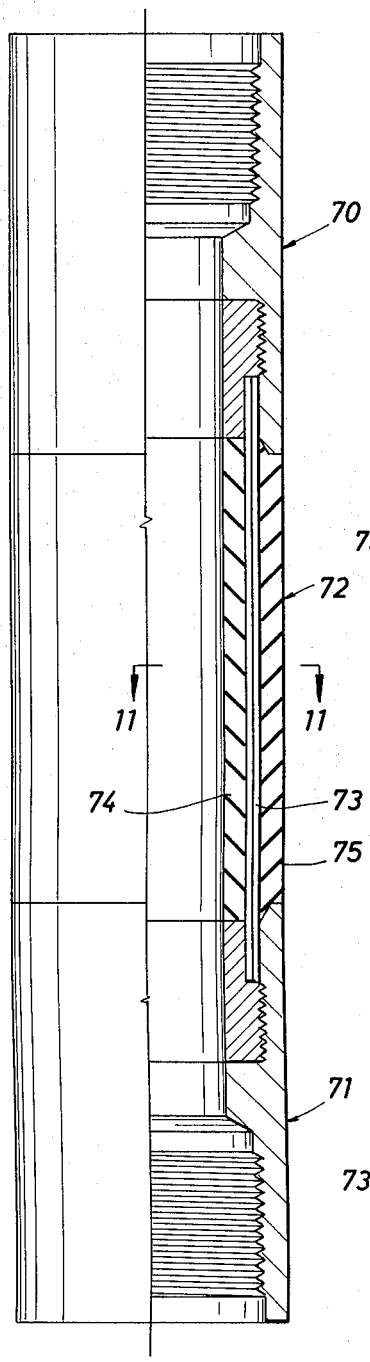
FIG. 9
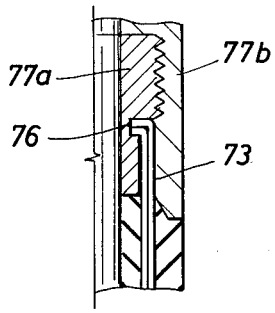
FIG. 10
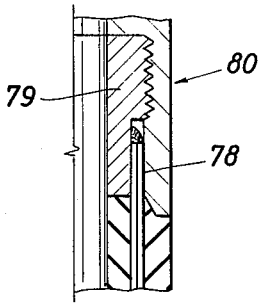
FIG. 11
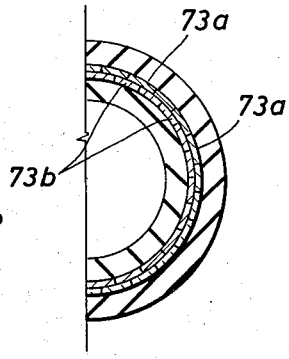
FIG. 13
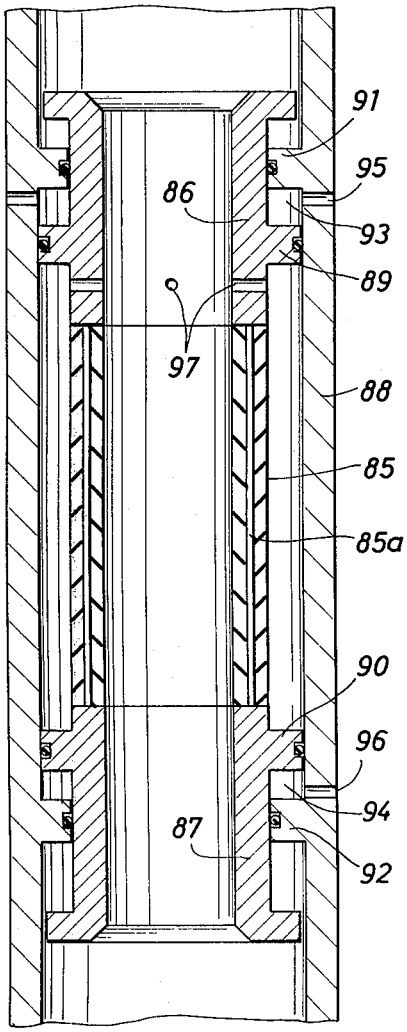
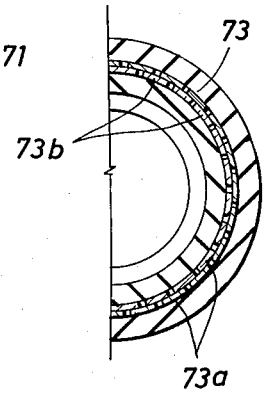
FIG. 12

WELL PACKER AND METHOD OF USE THEREOF

This invention relates to well packers generally and in particular to well packers that have compression-set packing elements.

Devices used to close annular passageways or conduits in a well bore are generally referred to as "packers." This refers to the whole tool. The actual sealing or bridging of the annular space to stop the flow of fluids therethrough is done by what is generally called a "packing element." When the packing element is in position closing an annular space, the packer is referred to as being "set."

As stated above, usually, packers are used to bridge and close annular passageways in a well bore. The outer wall of the annulus may be either the uncased wall of the well bore or casing, which has been run into a well bore and cemented in place. The inner wall of the annulus may be the outside surface of a string of drill pipe or tubing, or it may be the casing mentioned before, since there is an annular space between the outside of the casing and the well bore through which cement is pumped when the casing is being cemented in place.

There are generally three types of packing elements: the compression-set type, the pressure-set type, and the inflatable type. The compression-set type of packing element is used where the size of the annulus to be sealed is well known, because the lateral movement of a compression-type packing element is limited. Lateral movement is obtained by applying a compressive force axially to an annular member of elastomeric material, which causes the member to shorten and to expand laterally into engagement with the outer wall of the annulus being sealed. Obviously, this lateral movement cannot be great without causing a rupture or failure of the elastomeric material. The seal obtained between the inner and outer walls of the annulus by this type of packing element is directly proportional to the compressive force imposed on the packing element that holds the packing element compressed against the inner and outer walls of the annulus.

The pressure-set type of packing element is cup shaped and, therefore, is frequently referred to as a "packer cup." The cup-shaped packing element is carried on a mandrel and, usually, the outer edge or lip of the wall of the cup is in light engagement or very close to the wall of the outer wall of the annulus it is to seal. Pressure, in a direction opposite to that in which the cup is facing, will force the wall of the cup outwardly into sealing engagement with the outer wall of the annulus. Thus, it is the pressure differential across the cup that sets the packing element of this type. The cup-shaped packing element will hold a differential pressure only in one direction.

The third type is the inflatable type and it is this type of packing element that is used to bridge large annuluses, such as commonly found between a string of drill pipe and a well bore or between a casing string and the well bore. In both of these cases, the actual size of the annulus is never known before the packer is set; therefore, this type of packing element should have the ability to extend laterally across relatively wide annular spaces. In this type of packer, the packing element is attached at both ends to spaced packer heads on the mandrel. To set the packer, fluid is pumped between the packing element and the mandrel to force the packing element to balloon outwardly away from the mandrel and into sealing engagement with the opposite wall of the annulus. To keep the packing element from having to stretch longitudinally, one or both of the packer heads move toward the other along the mandrel as the packing element is inflated. The pressure inflating the packing element is always greater than the pressure differential across the packing element.

It is an object of this invention to provide a well packer with a packing element having some of the features of both a compression type packing element and an inflatable type packing element in that the packing element of this invention is set as a compression type packing element after which it functions as a combination compression type packing element and an inflatable packing element.

It is another object of this invention to provide an improved well packer and a method of setting the packer that, even though set by compression, can be used to bridge relatively large annular spaces and thus can be used to bridge the annulus between the drill pipe and the well bore, or between the casing and the well bore where the size of the annular space is not known.

It is another object of this invention to provide a well packer and a method of setting the packer that employs a compressive force on the packing element of the packer to initially move the packing element into sealing engagement with the wall of an annulus and internal pressure provided by the fluid upstream of the packing element to help hold the packing element in sealing engagement with the wall of the annulus in which it is set thus enhancing the sealing ability of the packing element in direct proportion to upstream pressure.

These and other objects, advantages and features of this invention will be apparent to those skilled in the art from a consideration of this specification, including the attached drawings and appended claims.

In the Drawings

FIG. 8 is a view, partly in section and partly in elevation, of an alternate embodiment of the packing element;

FIGS. 9 and 10 are sectional views through the upper end of a packing element of the type shown in FIG. 8 and a portion of a packer head showing alternate ways of attaching the reinforcing strips of the packing element to the packer head;

FIG. 11 is a sectional view taken along line 11—11 of FIG. 8; and

FIG. 12 is a view similar to FIG. 11 with the packing element in the expanded or set position; and FIG. 13 is a vertical sectional view through a hydraulically-set packer wherein the packing element is moved inwardly to close an annular space or a bore through a pipe string.

Figure 1:
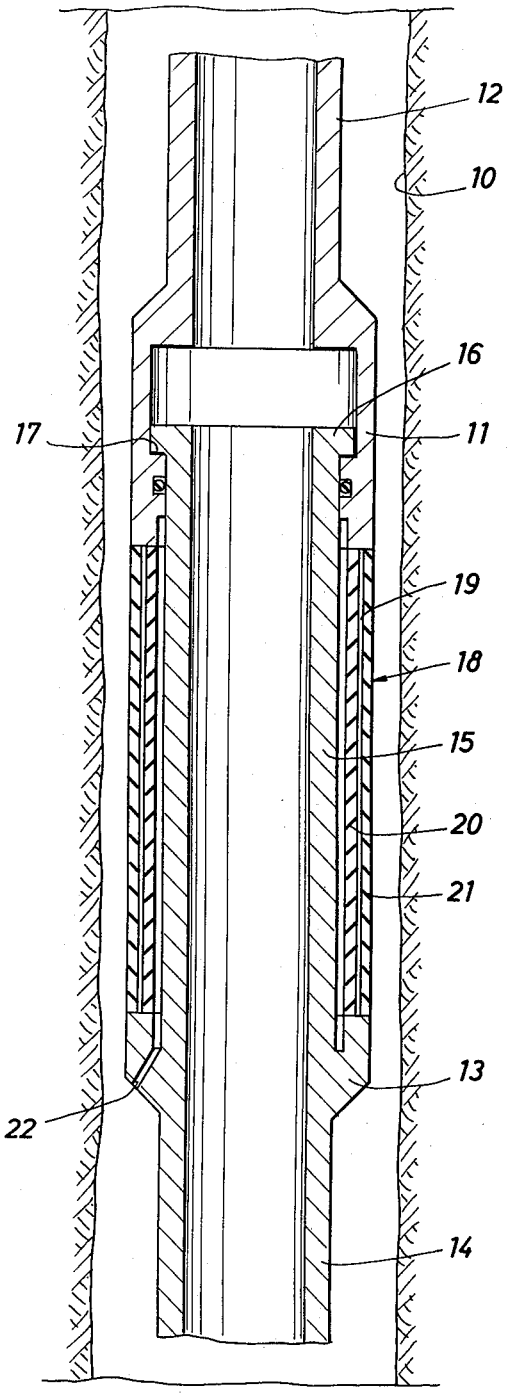
FIG. 1 is a vertical sectional view through a downhole packer embodying this invention and designed to be set by the weight of the pipe string above the packer.
Figure 2:
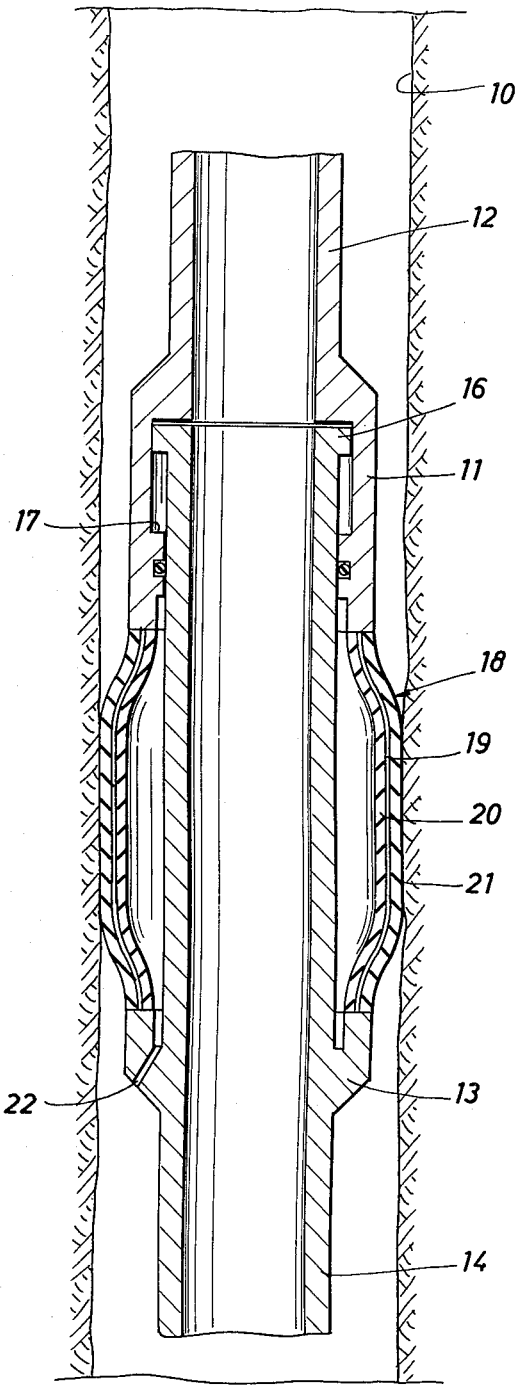
FIG. 2 is a cross-sectional view of the packer of FIG. 1 after the packer has been set.

In the packer shown in FIGS. 1 and 2, most of the details of construction have been omitted since these figures are primarily to illustrate the novel features of the packer of this invention and the method by which it is set.

The packer is shown connected in a pipe string extending through uncased well bore 10. The packer includes annular upper packer head 11, which is connected to drill pipe 12 extending above the packer. Lower packer head 13 is connected to drill pipe 14 extending below the packer. Lower packer head 13 is also connected to tubular mandrel 15, which extends upwardly into the bore of annular packer head 11. Outwardly extending flange 16 is connected to the upper end of the mandrel. Upwardly facing shoulder 17 on the upper packer head engages flange 16 and transfers the weight of the mandrel, the lower head and the drill pipe extending below the packer to the upper portion of the drill pipe. Splines or keys (not shown) may be used to prevent relative rotation between flange 16 and the upper head of the packer to allow rotation of the drill pipe to be transmitted through the packer for drilling operations.

Packing element 18 is positioned on the mandrel and extends between the upper and lower packer heads. As will be described in more detail below, packing element 18 includes a plurality of elongated reinforcing members or strips 19 that extend between the packer heads parallel to the longitudinal axis of the mandrel. The reinforcing strips are arranged in a circular pattern around the mandrel. The packer also includes inner sheath 20 made of elastomeric material located between the reinforcing strips and the mandrel and outer sheath 21 of elastomeric material, which surrounds the outside of the reinforcing strips.

To set the packer, the drill pipe is lowered into engagement with the bottom of the well bore or such other means as may be used to stop the drill pipe from downward movement. When this has occurred, further downward movement of portion 12 of the drill pipe above the packer will move packer head 11 downwardly toward packer head 13. This will bend reinforcing strips 19 outwardly until they have carried outer sheath 21 with them into engagement with the wall of well bore 10, as shown in FIG. 2. Inner sheath 20 will follow the outward movement of the reinforcing strips.

As the two packer heads move together and packing element 18 is moved outwardly into engagement with the outer wall of the annulus between the well bore and the mandrel of the packer, the volume of the annular space between the inside of the packing element and the mandrel will increase because the downward movement of the upper head is relatively small compared to the outward movement of the reinforcing members it produces. To prevent a pressure lock between the packing element and the mandrel, a plurality of openings 22 connects the space between the inner sheath and the mandrel with the annular space below packer head 13.

Opening 22 not only is provided to prevent a pressure lock from occurring inside the packing element, but also serves the important function of supplying upstream pressure to the inside of packing element 18. This pressure combining with the force exerted by the bent reinforcing strips exerts an outward force on the packing element, forcing the packing element further into sealing engagement with the wall of well bore 10. This pressure cannot exist until an upstream pressure exists, i.e., a pressure differential exists across the packing element, which can only occur after the packing element is initially set by compression. Contrary to an inflatable packer, the pressure inside the packing element will always be equal to but not higher than upstream pressure. This is sufficient, however, because the packer setting force is provided by the compressive force on the packer.

"Upstream" as used herein means the side of the packer where the pressure is highest. For example, the packer in FIG. 1 is being used as a downhole blowout preventer. It is anticipated then that the pressure below the packer will be greater than that above it since it is the purpose of the packer to seal the annulus between the drill pipe and the well bore from fluid flowing into the well bore below the packer. When this occurs, the packer can be set to prevent any further intrusion of formation fluid into the well bore while the density of the drilling fluid above the packer is increased sufficiently to offset the pressure in the formation. The packer can then be unseated and circulation resumed with the heavier mud to keep the well under control.

If this same packer is used as an open hole test tool, the pressure above the packer in the annulus would be substantially greater than the pressure below the packer. When so used, opening 22 would be located in the upper head of the packer connecting upstream pressure, which in this case is above the packer, to the inside of the packing element to help maintain the packing element in sealing engagement with the well bore, while the open hole test is being conducted.

Figure 3:
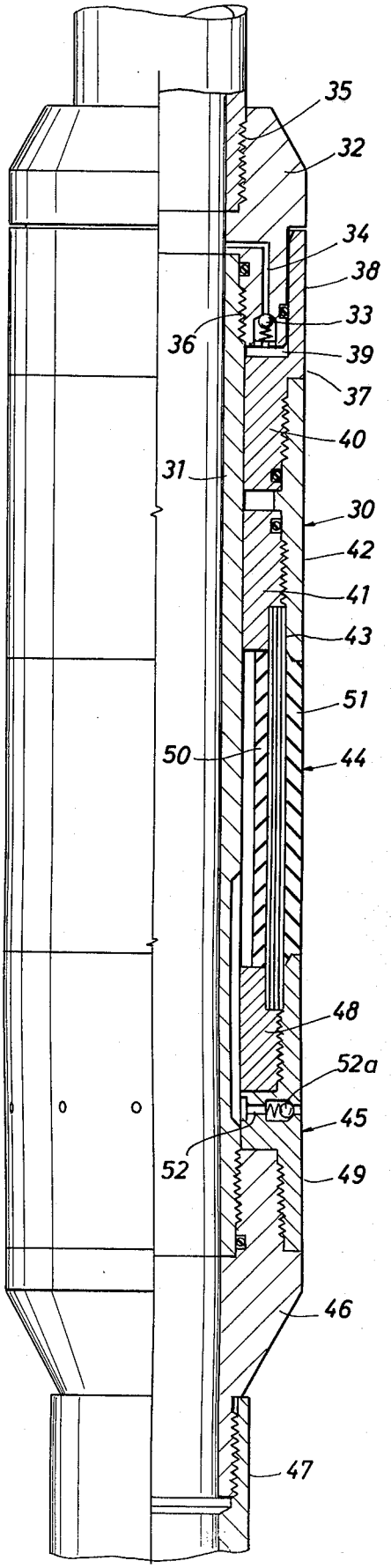
FIG. 3 is a view, partly in section and partly in elevation, of a downhole well packer of this invention that is set hydraulically.
Figure 4:
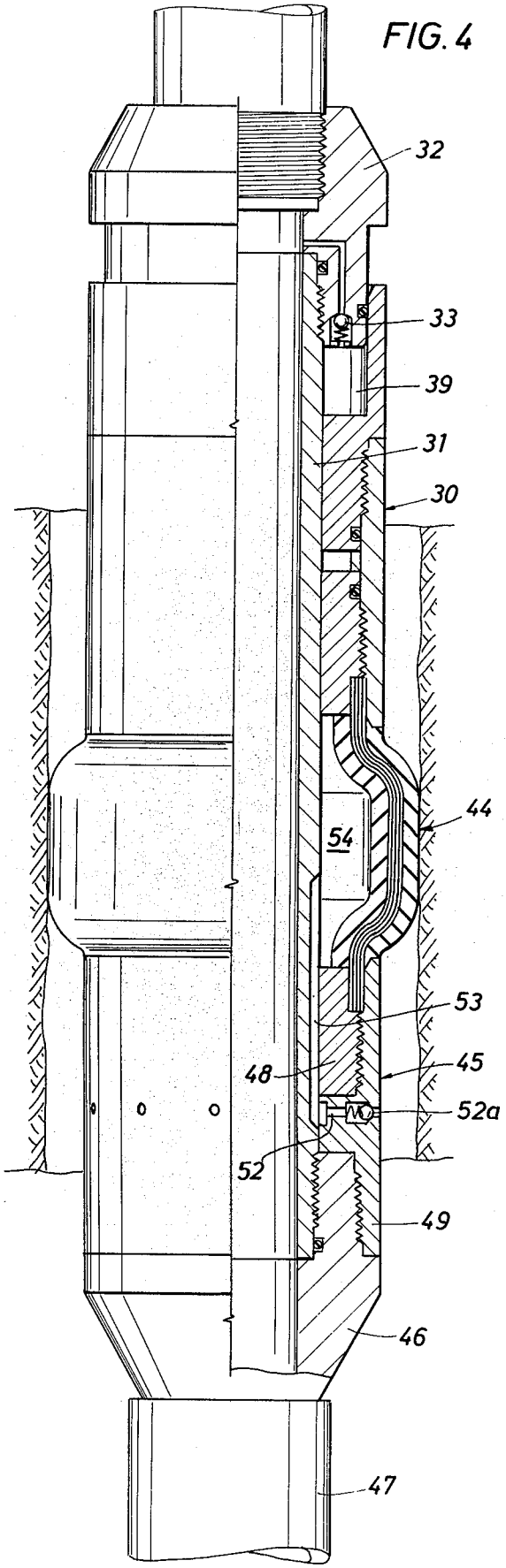
FIG. 4 is the packer of FIG. 3 in the set position.

In FIGS. 3 and 4 the packer of this invention is shown in use as an external casing packer. The packer is designed to be set by fluid pressure from inside the casing string.

Casing packers are used to provide seals between a string of casing and a well bore in addition to that provided by the cement placed between the casing and the well bore. They are also used with liners, well screens, and the like.

Upper packer head 30 includes an assembly of parts mounted on the outside of mandrel 31 for axial movement along the outside of the mandrel. The upper packer head includes check valve housing member 32, in which is located ball check valve 33. The check valve is in passageway 34, which connects the inside of the casing to cylinder 39. Check valve housing 32 also connects the packer to the joint of casing above the packer through threads 35. The check valve housing is also connected to the upper end of mandrel 31 through threads 36. The weight of the packer and the casing string below the packer is transferred to the casing string above through these threaded connections.

Cylinder sleeve member 37 is located below check valve housing member 33. It includes outer sleeve 38, which forms the outer wall of cylinder 39. The lower end of the cylinder is provided by annular section 40 of the cylinder sleeve member. Actually, the cylinder sleeve member is the piston, i.e., the moving part, which will be used to set the packer. The upper packer head also includes inner ring 41 and outer ring 42, which are connected together and to cylinder sleeve member 37. They are also connected to the upper end of packing element 44. Usually, reinforcing strips 43 of the packing element are attached in some way to one of the packer head members to hold them in the desired relative position. Some ways of doing this will be described below.

Lower packer head 45 is fixed to mandrel 31. It includes connector sub 46, which connects the packer to casing string 47 extending below the packer. It also includes inner and outer annular members 48 and 49 which are connected to the connector sub, to each other, and also to the lower end of packing element 44. The packing element includes, besides the reinforcing strips 43, inner sheath 50 and outer sheath 51.

In operation, check valve 33 is arranged to open at some preselected pressure inside the casing string. Preferably, if the packer is being used in a cementing operation, this will be just after the plug pumped down behind the cement engages the float collar and stops further circulation through the casing. This will cause a sharp build up in pressure in the casing. When the check valve opens, pressure will act against piston member 40, move it downwardly as shown in FIG. 4, and set packing element 44 in the manner described above in connection with the packer of FIGS. 1 and 2. There will be very little pressure differential across the packer at this time. Later, it could be on either side. In the packer shown, a plurality of passageways 52 in member 49 of the lower packer head connect the annulus with grooves 53 in the mandrel along which fluid can flow into space 54 between the inner sheath of the packer and the outside of the mandrel. If the fluid in the annulus filling in behind the packing element is cement slurry, when the cement hardens the packing element will be permanently held in the set position.

Check valve 33 will prevent the fluid in cylinder 39 from escaping, which will also hold the packer in the set position. The check valve may leak, however, so check valve 52*a* in passageway 52, which allows fluid to flow into but not out of space 54 is further insurance that the packer will remain set when the space is filled with a fluid other than cement. Increases in upstream pressure will still be transmitted to space 54.

Figure 5:
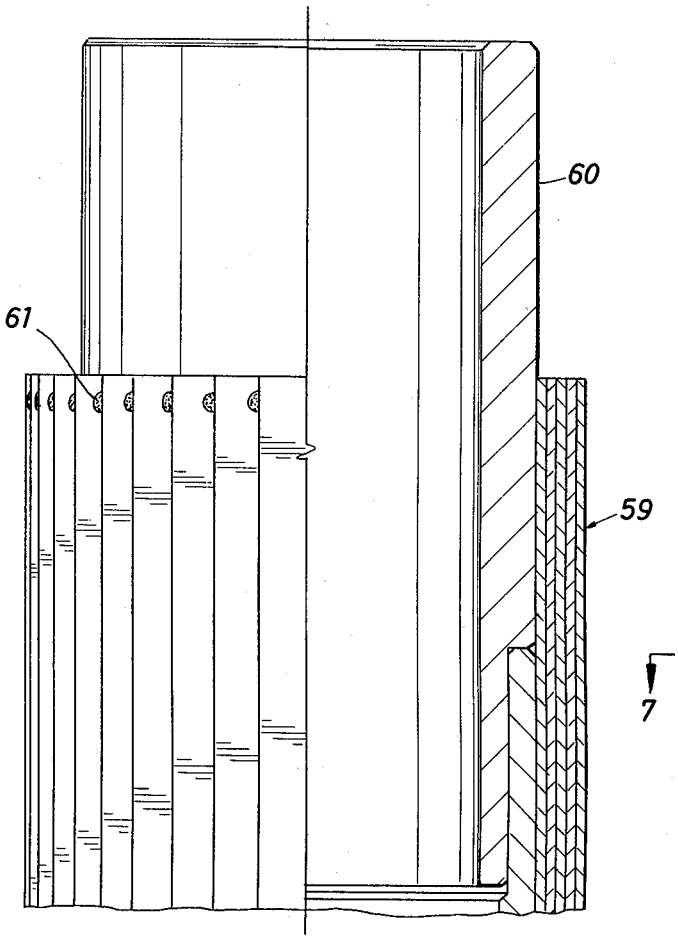
FIG. 5 is a view, partly in section and partly in elevation, of the reinforcing members of the packing element arranged on a fixture in position to be welded together prior to being assembled in the packing element of this invention.
Figure 6:
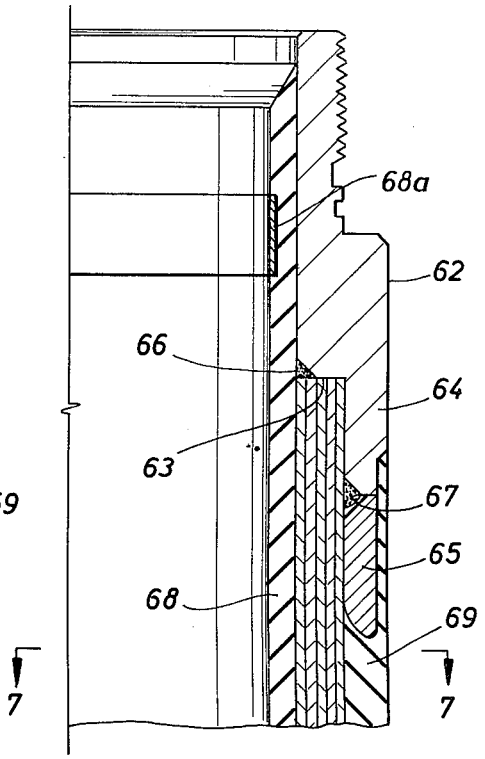
FIG. 6 is a sectional view of the upper end of one embodiment of the packing element of this invention and the packer head to which it is attached.
Figure 7:
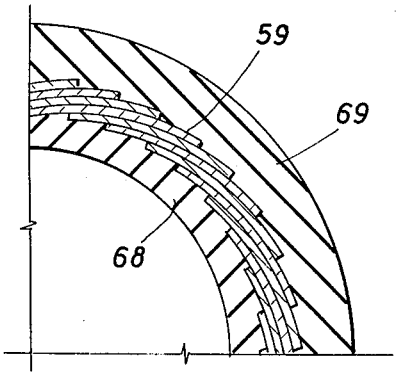
FIG. 7 is a view taken along line 7—7 of FIG. 6.

FIGS. 5, 6, and 7 show how the reinforcing strips are arranged in the preferred embodiment of the packing element. The reinforcing members are elongated relatively thin strips of material. As best seen in FIG. 7, they are slightly curved and are arranged in an overlapping manner so that the movement of one affects the movement of all the strips. In other words, they will move together when they are bent by the compressive force used to set the packer.

The reinforcing strips are usually made of metal. If the packer is one that is to be recovered after it has been set, a resilient material is preferred, such as spring steel. If the packer is going to be permanently left in the hole, then a less resilient material can be used. In fact, one that will take a permanent set when bent can be used satisfactorily.

Using a weldable material makes the assembly of the reinforcing members easier. In FIG. 5, the reinforcing members are arranged in the overlapping manner shown in FIG. 7 around tubular member 60, which acts as a fixture to support the reinforcing members in the desired circular path. Each member is tack welded to the adjacent member to hold the members in the desired relative position. These welds are indicated by the number 61 in FIG. 5. The other ends of the reinforcing members are tack welded in the same manner. The welded assembly is then removed from the fixture and the packer heads are attached.

As explained above, the packer heads take various shapes. In FIG. 6, annular packer head 62 has internal shoulder 63, which engages the ends of the reinforcing members. Annular portion 64 extends around the outside of the reinforcing members. Guide ring 65, which is not attached to the packer head or reinforcing members is slipped over the assembled members before the packer heads are attached. The packer head is attached to the reinforcing members by welds 66 and 67. After the welding, to complete the assembly, inner sheath 68 is slipped into position inside the packer heads and the reinforcing members and anchored in place by outwardly expanded brass ring 68*a*. Usually, outer sheath 69 is formed in place by wrapping elastomeric material around the assembled reinforcing members.

In FIGS. 8 through 12, an alternate arrangement for the reinforcing strips is shown. The packer of FIG. 8, includes upper packer head 70 and lower packer head 71. The packer heads are attached to opposite ends of packing element 72. The remainder of the packer, including the mandrel, is not shown.

Reinforcing members 73 are positioned between inner sheath 74 and outer sheath 75. The reinforcing member is arranged around the longitudinal axis of the packing element on two different diameters but in overlapping position. As shown in FIG. 11, reinforcing members 73*a* are further from the axis of the packing than are reinforcing members 73*b* and positioned so each member 73*a* overlaps a portion of two members 73*b*.

The packing element shown in FIG. 11 is designed to move outwardly when set since there is no room for the members to move together, which would be necessary if the packer bowed inwardly in the set position. In FIG. 12, the reinforcing strips are shown moved apart as they would be when the packer is set.

In FIGS. 9 and 10, alternate arrangements for anchoring the ends of the reinforcing members to a packer head are shown. In FIG. 9, the ends of reinforcing members 73 are bent inwardly to extend into grooves 76 in annular member 77*a* of the packer head assembly. Outer annular member 77*b* holds the ends of the members in the groove. In FIG. 10, the upper ends of reinforcing members 78 are welded to packer head member 79, which is a part of packer head assembly 80.

The packer of this invention can be used not only to close off an annulus, but also to close off the flow passageway through a conduit, such as a string of drill pipe. In FIG. 13, a rather simplified version of a packer for accomplishing this is shown. Packing element 85 is positioned between packer heads 86 and 87 and inside mandrel 88, which forms part of the pipe string. Annular flanges 89 and 90 on packer heads 86 and 87 respectively, combine with annular flanges 91 and 92 on the mandrel to form pressure chambers 93 and 94. When fluid under sufficient pressure is provided to these chambers through openings 95 and 96, the packer heads will be moved together and reinforcing members 85*a* and packing element 85 will bow inwardly, either to seal against a pipe string extending through this packer or to seal against itself and close the flow passage through the packer. Upstream pressure is supplied to the space between the packing element and the mandrel through openings 97 in packer head 86.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A well packer for controlling the flow of fluid through a conduit in a wall bore, such as through the annulus between the drill pipe and the wall of the well bore comprising a tubular mandrel positioned along the longitudinal axis of the conduit, spaced annular packer heads mounted on the mandrel with at least one movable along the mandrel toward the other packer head, a packing element including a plurality of elongated, relatively narrow, strips of reinforcing material connected to and extending between the packer heads and arranged in a circle to bend away from the mandrel when the packer heads are moved together and inner and outer sheaths of elastomeric material positioned inside and outside the reinforcing strips and between the packer heads with the ends of the inner sheaths in sealing engagement with the packer heads, means for moving one of the packer heads toward the other to cause the reinforcing strips of the packing element to bend away from the mandrel to move the center portion of the packing element away from the mandrel and into sealing engagement with the well bore, and an opening in one of the packer heads through which the fluid in the conduit that is upstream from the packing element can enter the space between the mandrel and the packing element to exert pressure on the inside of the packing element and provide an additional force holding the packing element in its set position that varies directly with upstream pressure and combines with the force exerted on the well bore by the reinforcing strips to provide sufficient friction between the packing element and the well bore to hold the packer from movement relative to the well bore.

2. The packer of claim 1 in which the reinforcing strips are made of spring steel.

3. The packer of claim 1 in which the means for moving the movable packer head toward the other includes a sleeve extending over one end of the mandrel for axial movement relative to the mandrel, said sleeve having one end connected to the drill string and one end connected to the movable packer head whereby with the mandrel held against movement the drill string can move the sleeve and movable packer head toward the other packer head and set the packer.

4. The packer of claim 1 in which the means for moving the movable packer head includes an annular chamber, a piston member in the chamber and movable relative thereto, means connecting the piston member to the movable packer head, and means for supplying the chamber with fluid under pressure to move the piston member and movable packer head and set the packer.

5. A packer for sealing the annular space between the packer and a well bore comprising a tubular mandrel, first and second annular packer heads mounted on the mandrel in axially spaced relationship, a plurality of reinforcing members of resilient material attached to the packer heads and arranged around the outside of the mandrel between the packer heads and parallel to the longitudinal axis of the mandrel, an inner sheath of elastomeric material located between the reinforcing members and the mandrel with each end in sealing engagement with one of the packer heads, an outer sheath of elastomeric material surrounding the mandrel, means for moving one of the packer heads toward the other along the mandrel to cause the reinforcing members to bow outwardly and move the outer sheath outwardly into sealing engagement with the wall of the well bore, and a passageway in one of the packer heads through which upstream fluid may flow into the inside of the inner sheath and exert pressure through the inner sheath urging the inner and outer sheath and reinforcing members outwardly against the well bore to anchor the packer in the well bore and to enhance the sealing ability of the packing element in direct proportion to the pressure differential across the packer.

6. A method of sealing the annular space between a pipe string and the wall of the well bore comprising applying a compressing force in an axial direction to an imperforate tubular packing element carried by the pipe string to force the packing element to bow outwardly away from the pipe string and into engagement with the well bore while holding the ends of the packing element from moving outwardly away from the pipe string, holding the compressing force on the packing element, and supplying the space between the bowed out packing element and the pipe string with fluid from the annular space that is upstream of the packing element to allow the pressure of such fluid to enhance the seal between the packing element and the wall of the well bore in proportion to the pressure differential across the packing element and to anchor the packing element in the well bore.

7. A method of using a downhole well packer to close the annulus between a drill string and the well bore, or the annulus between a string of casing and the well bore, comprising the steps of applying a longitudinal compressive force to a plurality of longitudinally extending reinforcing strips to bend the strips away from a mandrel located in the drill string while holding the ends of the reinforcing strings from movement away from the mandrel, casing string or the like to move an imperforate elastomeric sheath into sealing engagement with the well bore and supplying the space between the sheath and the mandrel with fluid from upstream of the packer after the annulus has been closed by the elastomeric sheath to enhance the sealing ability of the sheath and to anchor the packer in the well bore.

* * * * *